United States Patent [19]

Lempa

[11] 4,125,359

[45] Nov. 14, 1978

[54] BURNER ASSEMBLY

[75] Inventor: Roman F. Lempa, Philadelphia, Pa.

[73] Assignee: Selas Corporation of America, Dresher, Pa.

[21] Appl. No.: 810,966

[22] Filed: Jun. 29, 1977

[51] Int. Cl.[2] ..... F23C 5/28

[52] U.S. Cl. ..... 431/175; 431/187; 431/348; 239/397.5; 239/425

[58] Field of Search ..... 431/175, 183, 185, 187, 431/188, 348, 278; 239/397.5, 425

[56] References Cited

U.S. PATENT DOCUMENTS

| | | | |
|---|---|---|---|
| 2,669,300 | 2/1954 | Blaha | 431/348 |
| 2,855,033 | 10/1958 | Furczyk | 239/406 |
| 2,904,108 | 9/1959 | Blaha | 431/348 |
| 3,050,112 | 8/1962 | Saunders et al. | 431/175 |
| 3,076,498 | 2/1963 | Williams et al. | 431/348 |
| 3,088,681 | 5/1963 | McCutcheon | 239/425 |
| 3,139,138 | 6/1964 | Bloom | 431/175 |
| 3,159,200 | 12/1964 | Schuling et al. | 431/183 |
| 3,212,558 | 10/1965 | Williams | 431/348 |
| 3,315,726 | 4/1967 | Williams | 431/348 |

*Primary Examiner*—Carroll B. Dority, Jr.

*Attorney, Agent, or Firm*—Miller & Prestia

[57] ABSTRACT

A refractory burner block having a generally cup shaped depression is adapted for mounting in the furnace wall, with the depression facing the furnace interior. The block is provided with a bore that extends from the cup shaped depression to accommodate a burner nozzle. Resilient means connect the burner block with the cover plate so that both block and cover plate may independently contract and expand, minimizing stress loads on the cup, resulting in less cup cracking and failure.

A joint is provided with a step between the furnace wall and the burner block, reducing the possibility of gaps opening up and forming a barrier to radiant heat and to convection flow.

A central locating collar relieves the anchor bolts from undue stress in supporting the burner block. A resilient seal is used to seal the block against the central locating collar.

Pilot means to light the main burner and plenum means to buffer the pilot from the main burner are provided to reduce pilot "blowout."

17 Claims, 1 Drawing Figure

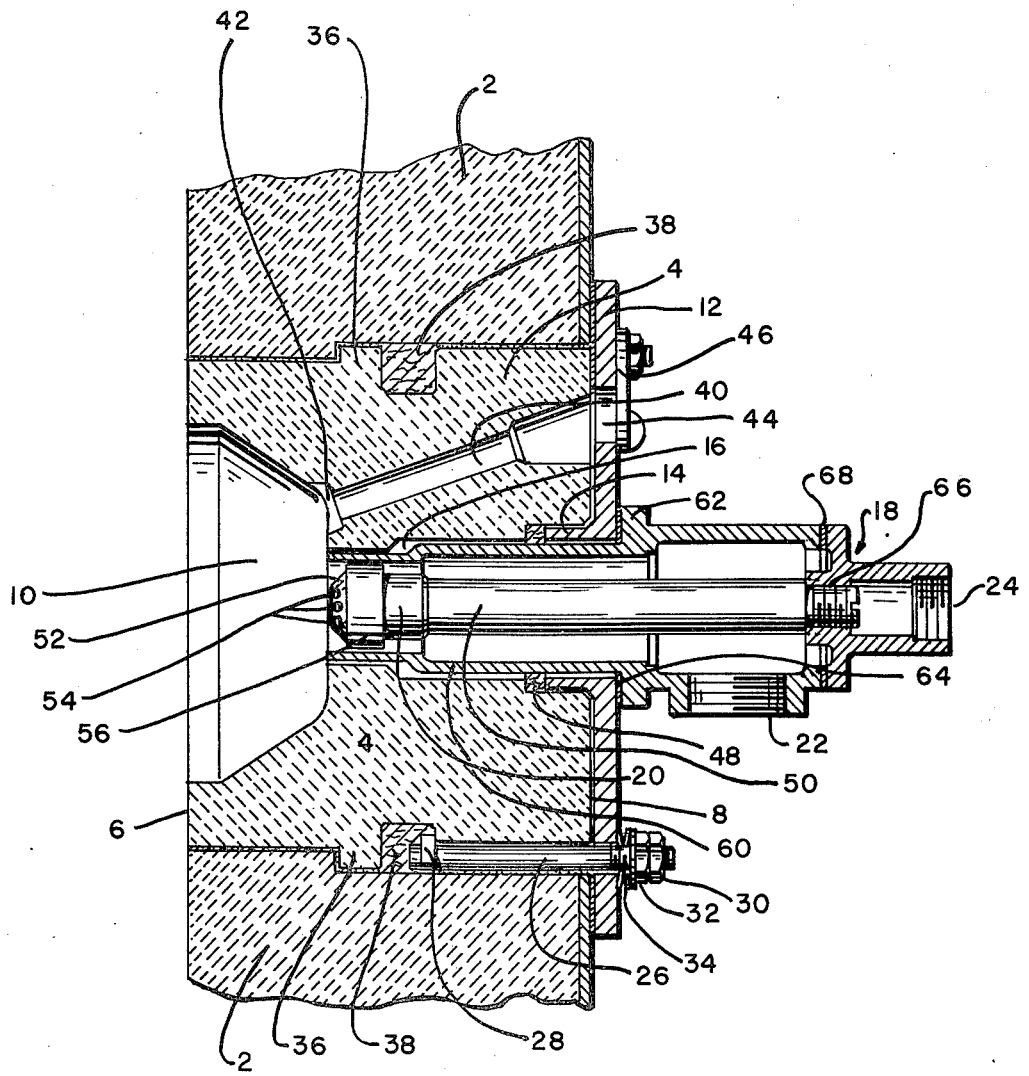
42
36
2
38
4
12
46
40
44
16
14
62
68
18
66
24
10
52
54
56
64
22
48
50
20
8
60
30
32
34
26
6
4
2
36
38
28

BURNER ASSEMBLY

BACKGROUND OF THE INVENTION

1. Field of the Invention

This invention relates to a high temperature furnace burner assembly adapted for installation in a furnace wall or roof of the type having a cavity formed therein so that the burner assembly can be readily installed and removed for repair or replacement. The main burner itself is adapted to intimately admix a fuel-air mixture and sweep the same across a cup type depression formed in the refractory burner block in a radial manner so that the the cup surface is always washed by the hottest portion of the flame.

2. Discussion of the Prior Art

Heretofore, several problems have been encountered in the radiant cup type burner field. Most burner assemblies comprise a burner mounted in a refractory block that is snugly inserted into a cavity formed in the furnace wall or roof. A metallic cover plate secures the burner block to the furnace housing (either the roof or sidewall). Due to the differing thermal characteristics of the refractory burner block and the metallic cover plate, uneven stresses are applied to the ceramic cup, causing cracking of the cup, or deterioration of the block altogether.

Moreover, some radiant cup burners include pilot channels that communicate with the cup portion of the burner. Often pneumatic forces caused by the aspirating effects of the main burner blow the pilot flame out.

Also, in some high temperature furnaces of the type contemplated, spaces between the burner block and furnace housing, and main burner and burner block are formed due to material degradation at high temperature; both causing loss of thermal efficiency.

Accordingly, it is an object of the present invention to provide a radiant cup type burner of the type contemplated wherein stress loads on the ceramic cup are minimized, thus resulting in greater efficiency and longer burner life.

Further, it is a more specific object to provide a radiant cup type burner of the type having a pilot channel disposed near the cup for easy lighting of the burner wherein interference between the pilot and main burner is minimized, thus resulting in fewer "blowouts."

It is even a more specific object to provide a radiant cup type burner assembly that will exhibit maximum sealing efficiency between burner block and housing, and main burner and burner block when the assembly is mounted in a furnace cavity, thus resulting in high thermal efficiency.

SUMMARY OF THE INVENTION

These and other problems inherent in the art are met by the novel burner disclosed herein. Basically, the burner includes a refractory burner block having an inner wall and an outer wall. The block is to be mounted in the furnace wall or roof cavity, and is formed with a generally cup shaped depression along the inner wall that faces the interior of the furnace.

The block mates with the housing in a manner more fully described hereinafter to provide maximum sealing efficiency, and the outer end surface of the block is connected to a metallic cover plate.

A bore extends through the block, running from the cup to the outer surface. The cover plate includes an annular collar mounted thereon that is coaxially disposed within the bore formed in the burner block. Thus, the cover and block form an easily assembled unit that readily fits into the desired furnace cavity.

A main burner of the type having a combustion nozzle and fuel inlet means is coaxially disposed within the block bore, with the nozzle end adjacent the cup shaped depression.

Resilient means, such as a spring biased anchor bolt, connect the cover and the burner block. Thus, despite the different heat characteristics of the refractory block and cover plate, a generally constant load is exerted on the cup, resulting in less cup cracking and greater thermal efficiency.

Further, pilot means to light the main burner may be provided. Surprisingly, it has been found that fewer pilot "blowouts" occur when the pilot is separated from the main burner. Accordingly, a plenum chamber is provided to separate these members.

The novel burner assembly also comprises a step up joint in the burner block that is adapted to extend along the block-housing interface. Further, a recess can be formed in the burner block to extend about the block-housing interface. The recess may be packed with mineral fibers to help minimize both radiant and convection flow heat losses through the interface.

Still further, means for sealing the collar to the block bore are provided so as to further enhance thermal efficiency by preventing recirculation of the fuel.

The invention will be further explained in the following detailed description in conjunction with the attached drawing wherein:

DESCRIPTION OF THE DRAWING

The drawing is a longitudinal view of a burner assembly in accordance with the invention.

DETAILED DESCRIPTION

In the attached FIGURE, the numeral 2 generally designates the furnace wall. Typically, the wall 2 comprises a refractory inner surface exteriorly covered by a metallic plate or the like. The wall 2 has an opening into which the burner assembly can be inserted.

The burner assembly comprises a refractory block 4 of high-temperature ceramic having inner wall 6 facing the furnace interior, and outer wall 8 facing the furnace exterior. Cup shaped depression 10 is formed in the inner wall of the block.

Metallic cover plate 12 with a collar 14 mounted thereon is attached to the block. Collar 14 is coaxially disposed within block bore 16 that extends from the cup shaped depression to the outer wall of the block. In shipment, during installation and thereafter the collar provides support for the assembly.

Main burner 18 is coaxially mounted within bore 16, and nozzle 20 of the main burner is adjacent the cup shaped depression. Sleeve 60 tightly fits within the block bore, and is sealed with the burner assembly by means of annular flange 62 and ring gasket 64. The main burner is secured in threaded boss 66 provided at the rearward end of sleeve 60. Air inlet 22 and fuel inlet 24 provide threaded joints that can be operatively connected with a source of air and fuel respectively.

Sleeve 60 is provided with gasket 68 to effect a tight fit.

The main burner may be of any type adapted to provide an intimate admixture of air and gas at the burner nozzle to fuel the cap. Preferably, the burner is of the type described in U.S. Pat. No. 2,855,033 to Furczyk, of common ownership herewith; the disclosure of said patent is herein incorporated by reference.

Gaseous fuel such as natural or manufactured gas, or an oil-stream mixture or the like is fed from inlet 24 through tube 50 into nozzle head 52. The gas is dispensed from the nozzle through radially disposed apertures 54 formed in the nozzle head. Air from inlet 22 passes through ribs 56 disposed about the nozzle head so that a whirling effect is imparted thereto. Of course, suitable valves (not shown) are disposed along the fuel and air feed lines, providing adjustable regulation of the air-fuel mixture.

The cover plate 12 is adjustably attached to the block 4 by resilient means, such as a spring biased anchor bolt 26 which, as shown, is anchored to the block 4 by lug 28. The bolt 26 extends through an aperture formed in the cover plate 12 and is secured thereto by threaded nuts 30, 32. Between the nuts 30, 32 and the cover plate 12 a spring washer is interposed to provide flexibility between cover plate 12 and block 4. The importance of this resilient coupling cannot be overemphasized. Since the (metallic) cover plate 12 and the (ceramic) burner block 4 usually have vastly different heat characteristics, the expansion and contraction of these members relative to each other applies uneven stress loads to the cup shaped portion of the burner block 4. The resilient connection compensates for these varying heat characteristics to prevent uneven loads, thus leading to increased burner block life. Although only one anchor bolt assembly is shown in the drawing, several such bolts are preferably spaced about the burner assembly.

Thermal efficiency is enhanced due to minimization of radiant and convection flow heat loss by the use of step joint or ridge 36 which extends around the housing-block interface. The use of the step joint helps eliminate block and/or housing deterioration and cracking common in many furnaces of this type having demountably attached burners.

Further, a recess 38 is provided in the block and extends around the block-housing interface. Mineral fibers such as asbestos or fiber glass are packed into the recess to further reduce convection gas flow through the interface. Also, as here shown, recess 38 provides a convenient structure with which bolt 26 can be anchored.

Breakable, filler cement is preferably applied along the block-housing interface for further insulation.

Pilot channel 40 is provided for lighting the burner. In nozzle mix type burners, wherein fuel and combustion air are passed through the burner into the combustion zone, due to the pressure differential between the fuel and air source and furnace interior, the inspirating fuel and combination air mixture often impinge on the pilot and blow it out. Surprisingly, a plenum chamber 42, provided at the channel portion adjacent the cup, provides the answer to the problem. As shown in the drawing, plenum chamber 42 comprises a counter bore coaxial with, and of larger diameter than, the pilot channel. Aperture 44 in plate 12 communicates with the pilot channel, and the channel can be selectively closed and opened via the use of pivotally mounted hatch cover 46.

Block bore 16 is formed as a series of successive stages, each stage increasing in cross sectional area from a first stage located adjacent the cup shaped depression 10 to the last stage adjacent the cup shaped depression 10 to the last stage adjacent the outer wall of block 4. Collar 14 is sealed to the last successive bore stage as shown at 48. Seal 48 is formed from a resilient cushion between the block and collar. Also, the seal prevents recirculation of gas that would otherwise exit between the bore-collar interface.

Accordingly, it will be apparent that important improvements are embodied in the burner block assembly of this invention, including:

(a) Spring pressure comes from a spring washer 34, applying a continuous load to the burner block. The spring thus minimizes the load on the ceramic cup due to differential heating and cooling between the ceramic and the metal.

(b) A joint is provided with a step between the furnace wall and the burner block. This reduces the possibility of gaps opening up and puts up a barrier to radiant heat and to convection flow as well. A second groove is provided for a ceramic anchor, in the alternative, and extends continuously around the structure. In this manner, a resilient material such as mineral fiber can be inserted into the second groove, for resisting radiation or hot gas flow.

(c) A central locating collar is provided which relieves the anchor bolts from undue stress in supporting the burner block. In shipment, during installation, and later, the central locating collar provides support. A resilient seal is used as a base for sealing the block against the central locating collar. This seal is never under as much compression as the spring washer referred to under Paragraph (a) above. This central seal prevents recirculation of gases.

(d) A plenum chamber is provided in the cup surface, at the inboard end of the lighter opening. In the past, difficulty has been experienced due to pneumatic forces which operate on the cup surface. The main burner and the lighting burner function as pumps, pumping gas and air into the cup. A problem has existed for some time, in that the main burner could exert a pressure or vacuum effect, possibly even blowing out the pilot flame. The plenum chamber isolates the main burner from the pilot burner and prevents each from interfering with the function of the other. The plenum chamber is circular in cross-section.

It will be understood that the above description of the present invention is susceptible to various modifications, changes and adaptations, and the same are intended to be comprehended within the meaning and range of equivalents of the appended claims.

The following is claimed:

1. In a burner assembly of the type comprising a refractory burner block inserted into a cavity of a furnace housing and wherein said burner block is shaped to mate with the cavity to form a burner block — cavity interface and an inner wall with a generally cup shaped depression formed therein to face the furnace interior and an outer wall to face the furnace exterior, a pilot bore extending through the burner block to facilitate lighting of the burner, the block further including a bore extending therethrough from the cup shaped depression through the outer wall, and wherein a plate is provided to cover the outer wall of the burner block, the improvement comprising:

(a) resilient means for resiliently connecting said plate and said burner block to adjustably compensate for the thermal contraction and expansion of said burner block and said plate to prevent uneven stress loads on said cup shaped depression;

(b) a step joint located on said block surface sides along said interface to reduce the possibility of gaps opening up and to prevent radiant heat and convection flow;

(c) a collar mounted on said plate, said collar coaxially disposed in said bore; and (d) a plenum chamber located adjacent said cup shaped depression and defining a counter bore coaxial with and of larger diameter than said pilot bore, said plenum chamber to buffer said pilot bore from said burner to prevent pilot blowout.

2. In a burner assembly of the type comprising a refractory burner block adapted for insertion into a furnace housing cavity, and wherein the burner block comprises an inner wall with a generally cup shaped depression formed therein to face the furnace interior and an outer wall to face the furnace exterior and wherein a plate is provided to cover the outer wall of the burner block, the improvement comprising: resilient means for resiliently connecting said plate and said burner block to adjustably compensate for the thermal contraction and expansion of said burner block and said plate to prevent uneven stress loads on said cup shaped depression.

3. An improved burner assembly as recited in claim 2 wherein said plate includes an aperture and wherein said resilient means comprise a bolt, a spring washer, and a bolt nut, one end of said bolt securely anchored to said block, the other bolt end fitting through said plate aperture with the nut threaded on said other bolt end and on top of said plate, said spring washer interposed between said plate and said nut.

4. In a burner assembly of the type comprising a refractory burner block inserted into a cavity of a furnace housing and wherein the burner block includes a surface that mates with the cavity to form a burner block-cavity interface and an inner wall with a generally cup shaped depression formed therein to face the furnace interior and an outer wall to face the furnace exterior, the improvement comprising: a step joint located on said block surface sides along said burner block-cavity interface to reduce the possibility of gaps opening up and to prevent radiant heat and convection flow, and a recess extending around the block-cavity interface, said recess containing fiber material to further reduce convection flow.

5. In a burner assembly of the type comprising a refractory burner block mounted within a furnace housing cavity, the block including an inner wall with a generally cup shaped depression therein to face the furnace interior, an outer wall to face the furnace exterior, and a bore extending through the burner block from the cup shaped depression through the outer wall, the assembly further comprising a burner mounted in the bore, and a pilot bore extending through the burner block to facilitate lighting of the burner, the improvement comprising: a plenum chamber defining a counter bore coaxial with and of larger diameter than said pilot bore, said plenum chamber located adjacent said cup shaped depression to buffer said pilot bore from said burner to prevent pilot blowout.

6. A burner assembly comprising in combination:

(a) a furnace housing having a cavity;

(b) a refractory burner block member to be mounted in said cavity, said block including an inner wall to face the furnace interior and an outer wall to face the furnace exterior, said inner wall including a generally cup shaped depression, said slides to mate with said furnace housing, said block further including a bore extending therethrough from said depression through said outer wall;

(c) a cover plate member with a collar mounted thereon, said plate connected to the outer wall of said burner block to cover said block with said collar coaxially disposed in said bore;

(d) a main burner having a combustion nozzle and fuel inlet means, said burner coaxially mounted in said bore with said combustion nozzle adjacent said cup shaped depression; and (e) resilient means connecting said members (b) and (c) to adjustably compensate for the thermal contraction and expansion of said members (b) and (c) relative to each other.

7. A burner assembly as recited in claim 6 wherein said cover plate includes an aperture and wherein said resilient means (e) comprise a bolt, a spring washer, and a bolt nut, one end of said bolt securely anchored to said block, the other bolt end fitting through said plate aperture with the nut threaded on said other bolt end and on top of said cover plate, said spring-type washer interposed between said plate and said nut.

8. A burner assembly as recited in claim 6 further including a step joint formed on said block surface sides.

9. A burner assembly as recited in claim 6 further including a recess formed in said block side surface.

10. A burner assembly as recited in claim 6 further including a pilot bore for lighting said main burner.

11. A burner assembly as recited in claim 10 wherein said pilot bore includes means for buffering said main burner from a pilot in said pilot bore.

12. A burner as recited in claim 11 including a pilot aperture formed in said cover plate, said pilot bore extending from said cup shaped depression and communicating with said pilot aperture.

13. A burner as recited in claim 12 wherein said buffer means comprise a plenum chamber defining a counter bore coaxial with, and of larger diameter than, said pilot bore, said counter bore located adjacent said cup shaped depression.

14. A burner as recited in claim 13 further including a hatch cover pivotally mounted on said cover plate and adapted to selectively cover and uncover said pilot aperture.

15. A burner as recited in claim 6 further including sealing means for sealing said collar to said block bore.

16. A burner as recited in claim 6 wherein said block bore is formed with a plurality of successive stages, said stages successively increasing in cross sectional area from a first stage located adjacent said cup shaped depression to a last stage adjacent said outer wall.

17. A burner as recited in claim 16 further including a sealing member interposed between said collar and said last successive stage.

* * * * *

UNITED STATES PATENT OFFICE

CERTIFICATE OF CORRECTION

PATENT NO. : 4,125,359

DATED : November 14, 1978

INVENTOR(S) : Roman F. Lempa

It is certified that error appears in the above-identified patent and that said Letters Patent are hereby corrected as shown below:

Column 2, line 34, after "longitudinal" insert --sectional--;

Column 2, line 67, after "the" delete "cap" and insert --cup--;

Column 3, line 4, after "an" delete "oil-stream" and insert --oil-steam--;

Column 3, line 52, after "the" delete "inspirating"

Column 3, line 53, after "and" delete "combination" and insert --combustion--;

Column 3, lines 65 and 66, after "adjacent" delete "the cup shaped depression 10 to the last stage adjacent";

Column 3, line 68, after "resilient" insert --compressible material further providing a resilient--.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*